US006448520B1

(12) United States Patent
Inoue

(10) Patent No.: US 6,448,520 B1
(45) Date of Patent: Sep. 10, 2002

(54) PUSH BUTTON SWITCH

(75) Inventor: Takefumi Inoue, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/877,865

(22) Filed: Jun. 8, 2001

(30) Foreign Application Priority Data

Jun. 16, 2000 (JP) ..... 2000-181103

(51) Int. Cl.[7] ..... H01H 13/70

(52) U.S. Cl. ..... 200/344; 200/517; 200/345; 200/341

(58) Field of Search ..... 200/344, 345, 200/512–517, 341–343; 400/490–495

(56) References Cited

U.S. PATENT DOCUMENTS 5,278,374 A 1/1994 Takagi et al.
5,519,569 A 5/1996 Sellers
5,562,203 A 10/1996 Mochizuki
5,590,020 A 12/1996 Sellers
5,602,715 A 2/1997 Lempicki et al.
5,833,050 A 11/1998 Takagi et al.
5,894,117 A * 4/1999 Kamishima ..... 200/344
6,160,233 A * 12/2000 Hu ..... 200/341
6,179,497 B1 * 1/2001 Hu ..... 200/344
6,318,695 B1 * 11/2001 Hu ..... 200/345

* cited by examiner

*Primary Examiner*—Elvin Enad
*Assistant Examiner*—Marina Fishman
(74) *Attorney, Agent, or Firm*—RatnerPrestia

(57) ABSTRACT

A push button switch is utilized in an input unit of a thin electronic apparatus is provided. A link member assembled in X-shape for supporting a key top capable of moving vertically. A base slidably supports a lower latched shaft of a first frame of the link member. The base pivotably supports a lower latched shaft of a second frame of the link member. A driving spring impels the lower latched shaft of the first frame in the central direction of the link member, and elastically deforms downwardly by a horizontal movement of the lower latched shaft to operate a switch member. An operating spring is pressed by the lower latched shaft to deform horizontally and elastically.

22 Claims, 16 Drawing Sheets

PUSH BUTTON SWITCH

FIELD OF THE INVENTION

The present invention relates to a push button switch used for an input unit of an electronic apparatus such as a thin notebook-type personal computer.

BACKGROUND OF THE INVENTION

A conventional push button switch will be explained with referring to FIG. 14 through FIG. 17.

FIG. 14 is a plan view of the conventional push button switch, FIG. 15 is a sectional view of the switch, FIG. 16 is an apparent perspective view of a link member of the switch, and FIG. 17 is a sectional view of the switch during a pressing operation. Key top 1 made of resin has cylindrical stem 1A on the lower surface of the center of the key top and a pair of engaging parts 1B at both sides on the lower surface. As shown in FIG. 16, resin-made frame 2 having substantially a square U-shape has a pair of parallel arms 2C1, 2C2 which include cylindrical spindles 2A, 2B1 (2B2) at both ends, respectively, and spindle 2A for coupling one end of the arm 2C1 to that of the arm 2C2. Substantially central parts of arms 2C1, 2C2 of frame 2 have cylindrical shafts 2D1, 2D2, respectively. Resin-made frame 3 having substantially a square U-shape similarly has a pair of parallel arms 3C1, 3C2 which include cylindrical spindles 3A, 3B1 (3B2) at both ends, respectively, and spindle 3A for coupling one end of the arm 3C1 to that of the arm 3C2. Substantially central parts of arms 3C1, 3C2 of frame 3 have long holes 3D1, 3D2, respectively. Shafts 2D1, 2D2 of frame 2 are pivotably and slidably supported by long holes 3D1, 3D2 in frame 3. Frames 2, 3 are coupled to each other in an X-shape in side view to form a link member 4. Spindles 2B1, 2B2 and spindles 3B1, 3B2 in the upper parts of link member 4 are pivotably held on respective pairs of engaging parts 1B disposed at both sides on key top 1.

Spindles 2A, 3A in the lower parts of link member 4 are pivotably and slidably held between each pair of engaging recesses 5B disposed at both sides on resin-made case 5 and switch member 6 under the case. Switch member 6 includes a flexible upper sheet, a movable contact on the lower surface of the upper sheet, a lower sheet, a fixed contact on the upper surface of the lower sheet, and a spacer interposed between both sheets. Therefore, the movable contact faces to the fixed contact. The movable contact and fixed contact touch with each other by pressing switch member 6 with projection 7A on a lower surface of the central part of substantially conical dome part 7. Dome part 7 is made of elastic material such as rubber and placed over the upper surface of switch member 6.

Case 5 includes, at the center, guide hole 5A for engaging and supporting stem 1A of key top 1 and dome part 7, and engaging recesses SB at both sides on guide hole 5A. Metal substrate 8 reinforces the lower surface of switch member 6.

An operation of a push button switch having such a structure will be described. When key top 1 has the upper surface pressed down with a finger, link member 4 held by engaging parts 1B pivots on cylindrical spindles 2B1, 2B2 and 3B1, 3B2. Spindles 2A, 3A which are pivotably and slidably held between case 5 and switch member 6 pivot and slide along recesses 5B.

Frames 2, 3 of link member 4 are supported with cylindrical shafts 2D1, 2D2 in the substantially central parts of arm 2C1, 2C2 and long holes 3D1, 3D2 in the substantially central parts of arm 3C1, 3C2, and are interlocked. When key top 1 is pressed and operated, therefore, key top 1 is pressed down with keeping a substantially horizontal attitude as shown in FIG. 17. Key top 1 pushes and bends dome part 7, and thus, projection 7A on the lower surface of dome part 7 presses switch member 6 to turn on the switch to generate a predetermined signal.

When a pressing force applied to key top 1 is subsequently removed, dome part 7 returns to an original shape due to the elastic restoring force and press back link member 4 and key top 1, and thus the original state shown in FIG. 15 is provided.

Although having a good operability, the conventional push button switch includes tall dome part 7 between key top 1 and switch member 6. Additionally, guide hole 5A for positioning dome part 7 and key top 1 makes the switch entirely high and not easily applicable to a recent thin electronic apparatus.

SUMMARY OF THE INVENTION

A thin push button switch easily applied to a thin electronic apparatus is provided.

The switch includes the following elements:

(a) A vertically-movable key top including first and second holding parts;

(b) A first frame having a first end pivotably held by the first holding part, and a second end;

(c) A second frame having a first end pivotably and slidably held by the second holding part, and a second end. A substantially central part of the frame is pivotably coupled to the first frame in an X-shape through a coupling part at a substantially central part of the first frame;

(d) A substantially plate-like base including a first support part for pivotably and horizontally-slidably supporting the second end of the first frame, and a second support part for pivotably supporting the second end of the second frame;

(e) An operating spring disposed between the base and the key top, and elastically deformed outward by the second end of the first frame;

(f) A driving spring for elastically contacting with the second end of the first frame from the lower side and for impelling the second end of the first frame inward. The spring has a tapered part pushed by the second end of the first frame; and (g) A switch member disposed under the driving spring. The member includes switch contacts pressed and operated by the driving spring.

Another push button switch includes the following elements:

(a) A vertically-movable key top including first and second holding parts;

(b) A first frame having a first end pivotably held by the first holding part, and a second end;

(c) A second frame having a first end pivotably and slidably held by the second holding part, and a second end. A substantially central part of the frame is pivotably coupled to the first frame in an X-shape through a coupling part at a substantially central part of the first frame;

(d) A third frame having a first end pivotably held by the first holding part coaxially at the coupling part;

(e) A plate-like base including a first support part for pivotably and horizontally-slidably supporting the second end of the first frame and the second end of the third frame, and a second support part for pivotably supporting the second end of the second frame;

(f) An operating spring disposed between the base and the key top, elastically deformed outward by the second end of the first frame;

(g) A driving spring elastically contacting with the second end of the third frame from the lower side for impelling the second end of the third frame inward. The spring has a tapered part pushed inward by the second end of the third frame; and (h) A switch member including switch contacts disposed under the driving spring and pressed and operated by the driving spring.

A thin push button switch can be obtained in which a pressing operation force can be adjusted by changing the pressure of the operating spring. The push button switch including a downsized operating spring has a small projected area.

DESCRIPTION OF THE PREFERRED EMBODIMENTS

Embodiment 1

Figure 1:
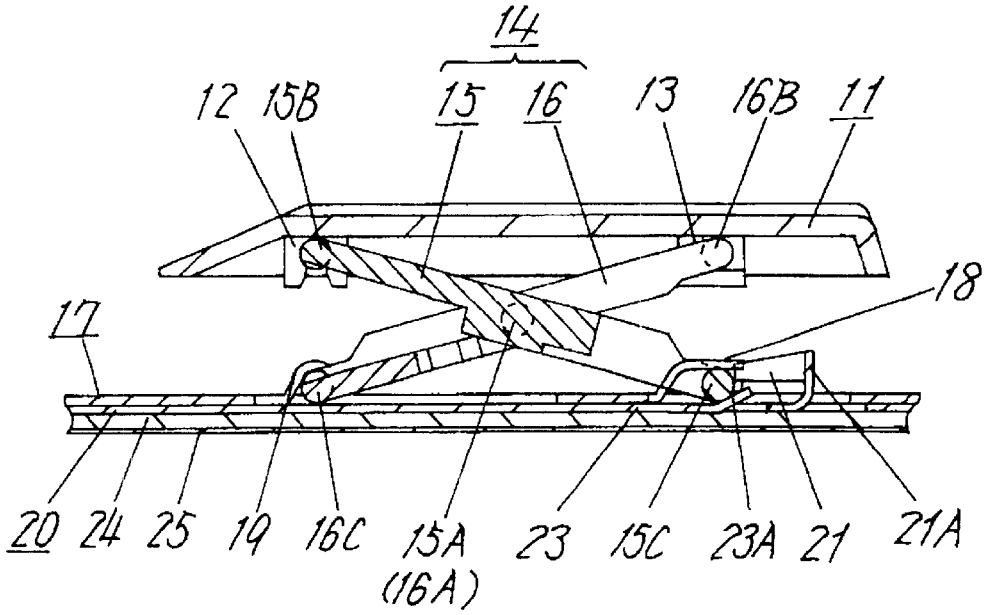
FIG. 1 is a sectional view of a push button switch in accordance with exemplary embodiment 1 of the present invention.
Figure 2:
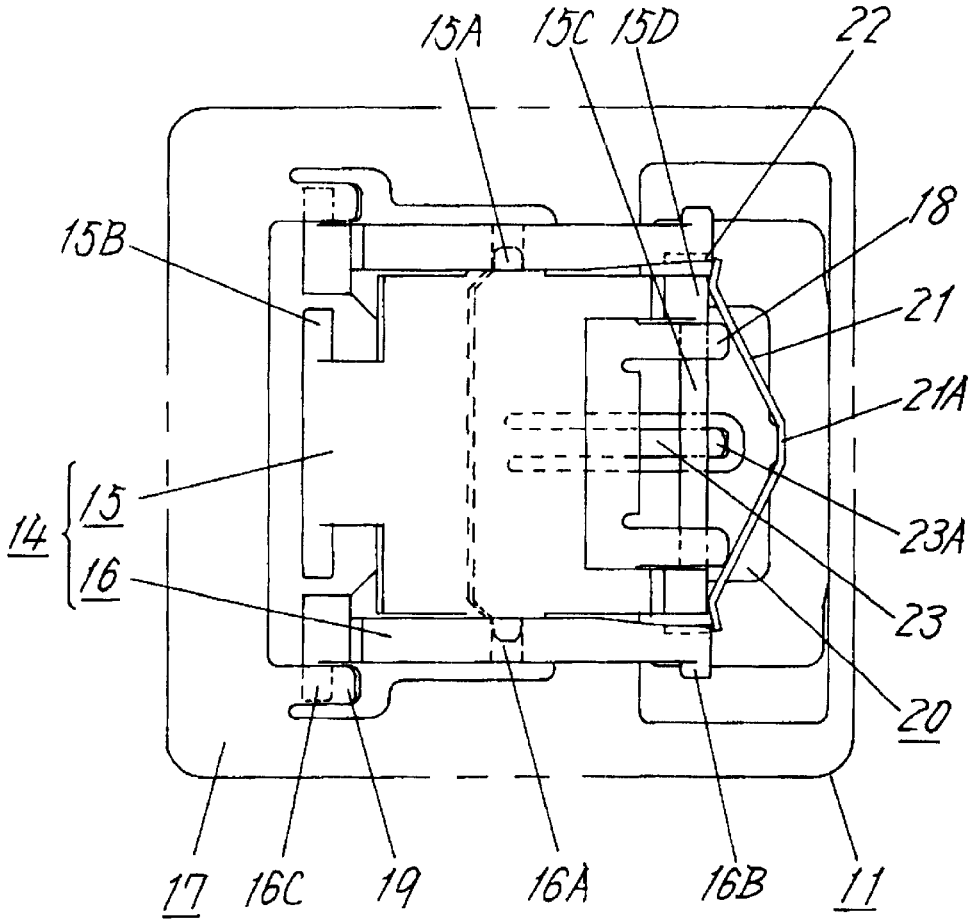
FIG. 2 is a plan view of the switch except for a key top in accordance with embodiment 1.
Figure 3:
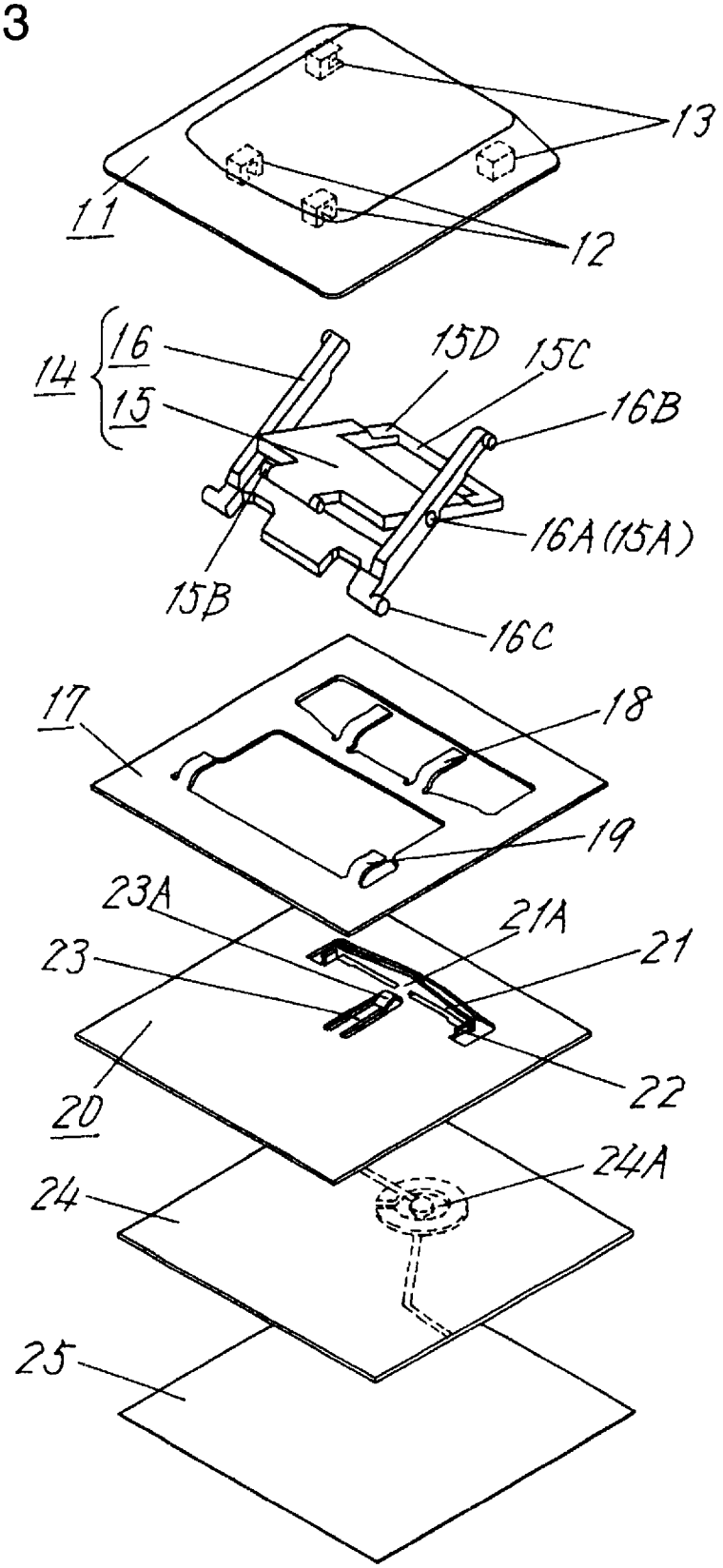
FIG. 3 is an exploded perspective view of the switch in accordance with embodiment 1.
Figure 4:
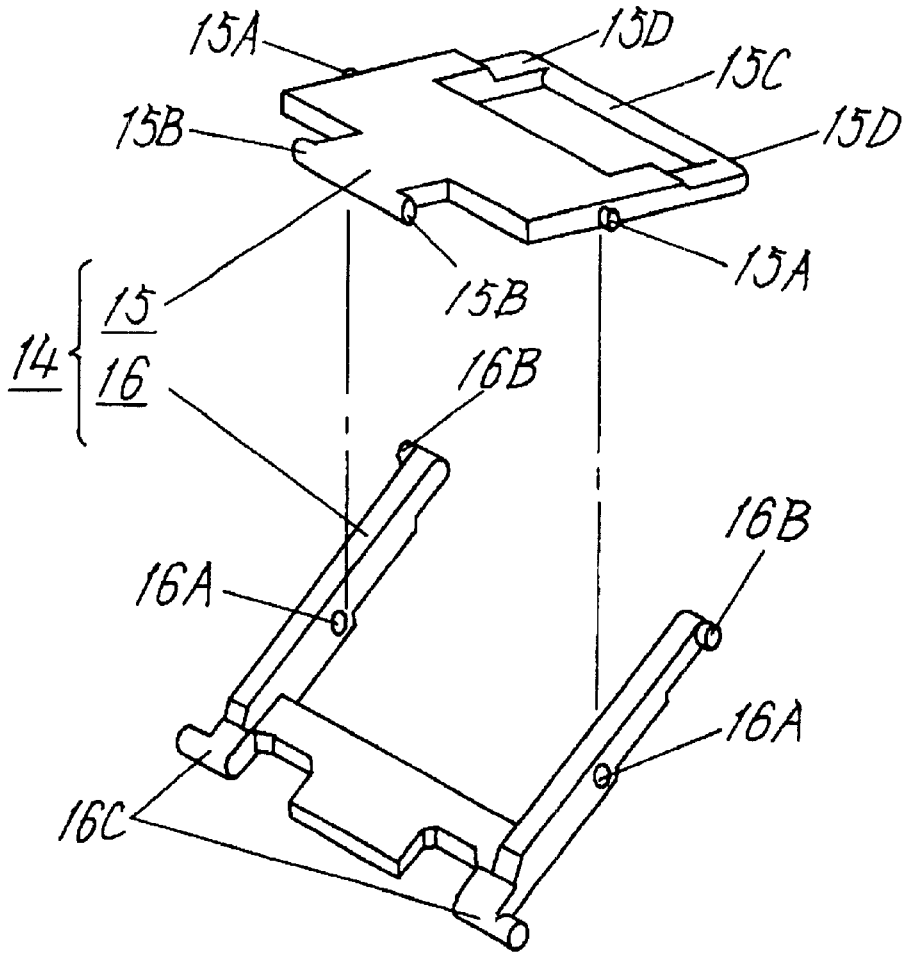
FIG. 4 is an exploded perspective view of a link member of the switch in accordance with embodiment 1.

FIG. 1 is a sectional view of a push button switch in accordance with exemplary embodiment 1 of the present invention, FIG. 2 is a plan view of the switch except for a key top, FIG. 3 is an exploded perspective view thereof, and FIG. 4 is an exploded perspective view of a link member as an important part thereof.

In FIG. 1 through FIG. 3, resin-made key top 11 of which upper surface is a pressing operation surface has pair of first holding parts 12 and pair of second holding parts 13 on its lower surface, and is held vertically movably by link member 14 engaged with them. Link member 14, as shown in FIG. 3 and FIG. 4, comprises first frame 15 in a substantially quadrangle plate shape and second frame 16 in a substantially square U shape that are both made of resin. Circular projections 15A on both side surfaces of the intermediate part of first frame 15 are pivotably engaged and coupled with circular holes 16A in the intermediate part of both-side arms of second frame 16, and frames 15, 16 are assembled in an X shape in side view.

As shown in FIG. 1, upper latched shafts 15B on both surfaces of the upper end of first frame 15 are pivotably held by first holding parts 12 of key top 11. The both ends of lower latched shaft 15C in a circular shaft shape at the lower end of frame 15 are sandwiched between pair of first support parts 18 of base 17 in a lower part and the upper surface of spring plate 20 under the first support parts 18, and are supported pivotably, slidably, vertically un-movably.

Upper latched shafts 16B on both surfaces of the upper end of second frame/6 are pivotably and slidably held by second holding parts 13 of key top 11. Lower latched shafts 16C on the both sides of the lower end of second frame 16 are pivotably sandwiched between pair of second support parts 19 of base 17 and the upper surface of spring plate 20.

Base 17 is made of a metal plate, and includes pair of first support parts 18 and pair of second support parts 19 that are respectively formed by punching and bending the metal plate. Positions of first support parts 18 and second support parts 19 are thus accurate, and the push button switch has high rigidity on the whole. Particularly, first support parts 18 can have a rib as necessary to improve the rigidity.

Spring plate 20 is made of a thin elastic metal plate, and comprises spring support part 21A unitarily formed by punching and bending the thin metal plate, operating spring 21 extending from support part 21A, and stoppers 22. Support part 21A and spring 21 project over base 17, are held in a state in which stoppers 22 apply a predetermined initial pressure to them, and face to lower tip 15D of the outside of lower latched shaft 15C of first frame 15. Initial pressure of operating spring 21 held by stoppers 22 allows adjustment of an operation force of the push button switch.

Additionally, spring plate 20 unitarily comprises driving spring 23 as a cantilever plate spring under first frame 15. Tapered part 23A bent upwardly at the tip of spring 23 presses a central part of lower latched shaft 15C at the lower end of first frame 15 to energize it toward the center of link member 14. Link member 14 is thus held in a state in which it is raised, namely key top 11 is pushed up. In this state, lower tip 15D of first frame 15 does not contact with operating spring 21, and is separated from spring 21 by a slight distance. Spring support part 21A of operating spring 21 lies outside tapered part 23A at the tip of driving spring 23.

Figure 5:
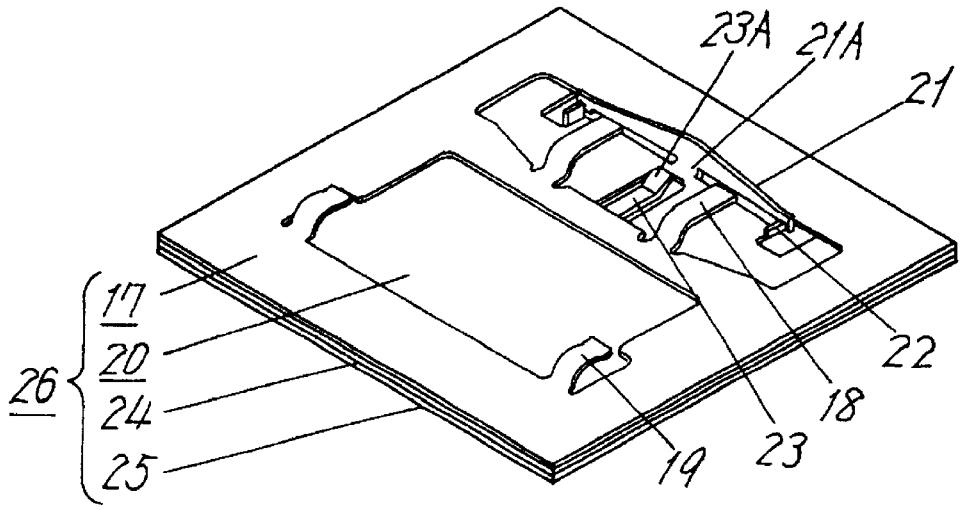
FIG. 5 is an apparent perspective view of a sheet member of the switch in accordance with embodiment 1.

Spring plate 20 is piled on switch member 24. Switch member 24 comprises a flexible upper sheet, a movable contact on the lower surface of the upper sheet, a lower sheet, a fixed contact on the upper surface of the upper sheet, and a spacer interposed between both sheets. The movable contact and the fixed contact provide opposite switch contacts 24A facing to each other to form a membrane switch. Opposite switch contacts 24A lie directly underneath the root of tapered part 23A of driving spring 23. Switch member 24 is piled on metallic substrate 25 for improving rigidity of the push button switch to stabilize an operation. FIG. 5 is an apparent perspective view of sheet member 26 formed by piling base 17, spring plate 20, and switch member 24 on metallic substrate 25.

Since the push button switch thus comprises a sheet member integrally formed with various members, number of members for structuring the push button switch is reduced, the switch is easily assembled, and positional relations of various members can be correctly managed.

A motion of the push button switch with such a structure in accordance with embodiment 1 during a pressing operation will be described with reference to a sectional view during the pressing operation shown in FIG. 6A and a plan view of the switch except for key top shown in FIG. 6B.

Figure 6A:
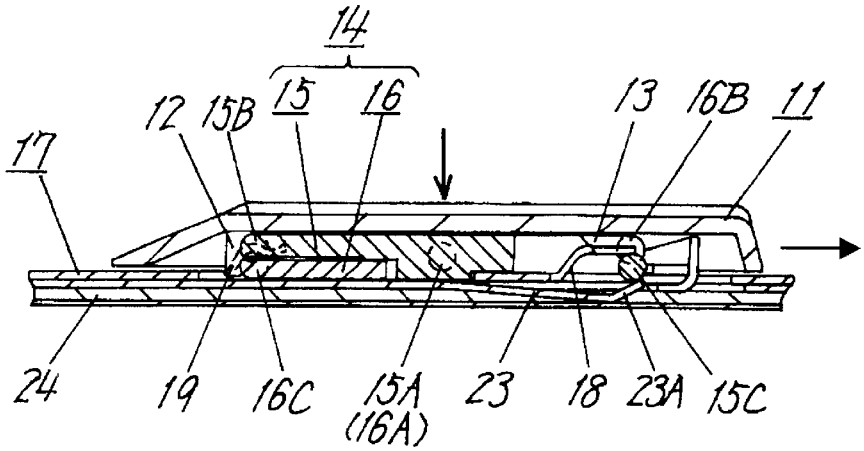
FIG. 6A is a sectional view of the switch in accordance with embodiment 1 during a pressing operation.
Figure 6B:
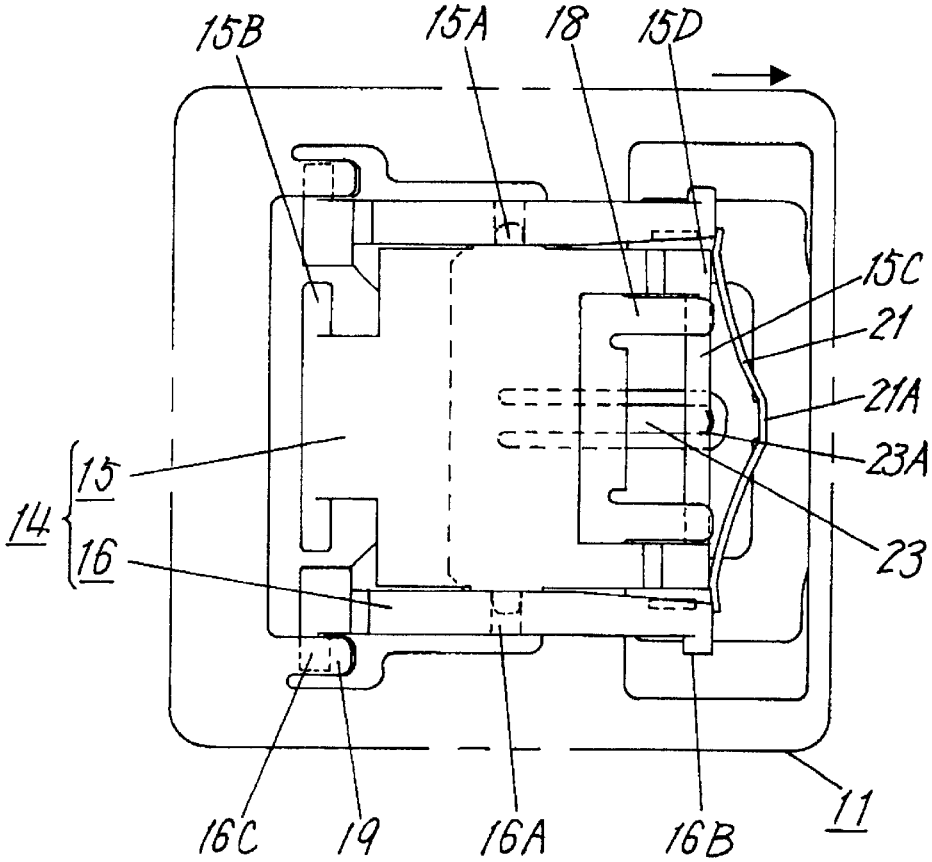
FIG. 6B is a plan view of the switch except for the key top in accordance with embodiment 1.

When a pressing operation surface of key top 11 is pushed down from the state shown in FIG. 1 in the arrow direction shown in FIG. 6A, first frame 15 and second frame 16 pivot on engaging parts between circular projections 15A of first frame 15 and circular holes 16A of second frame 16, and link member 14 starts to be folded.

At this time, upper latched shafts 15B of first frame 15 are pivotably supported by first holding parts 12 of key top 11, and do not move. Lower latched shafts 16C of second frame 16 are also pivotably supported by second support parts 19 of base 17, and do not move. Lower latched shaft 15C of first frame 15 move outwardly, extendedly in first support parts 18 of base 17. Upper latched shafts 16B of second frame 16 are move outwardly, extendedly in second holding parts 13 of key top 11. The central part of lower latched shaft 15C at the lower end of first frame 15 is first moved in the direction for slightly raising tapered part 23A of driving spring 23 by a slight pressing force, and therefore, lower tip 15D of first frame 15 bumps against operating spring 21 applied with an initial pressure. Then, as shown in FIG. 6B, lower tip 15D presses and elastically deforms operating spring 21, and operating spring 21 generates an operating force of key top 11, namely the push button switch. The central part of lower latched shaft 15C at the lower end of first frame 15 presses tapered part 23A of driving spring 23 by the slight pressing force, and then, with a large force, presses and elastically deforms operating spring 21 applied with the initial pressure. Therefore, the push button switch feels soft during the pressing operation.

In accordance with the movement discussed above, the central part of lower latched shaft 15C at the lower end of first frame 15 further raises tapered part 23A of driving spring 23 to elastically deform and press down driving spring 23. Driving spring 23 then pushes opposite switch contacts 24A of switch member 24 lying directly underneath the root of tapered part 23A to establish a short circuit.

When key top 11 is further pressed down after that, a plate-like arm of driving spring 23 elastically deforms, first frame 15 finally overlaps on second frame 16 and link member 14 is perfectly folded as shown in FIG. 6A.

When a pressing force applied to key top 11 is removed, an elastic restoring force between operating spring 21 and driving spring 23 raises link member 14 to the original state shown in FIG. 1, and returns key top 11 to the predetermined position.

When both first frame 15 and second frame 16 forming link member 14 are made of resin, the push button switch can be lightened. The push button switch is therefore advantageous when many push button switches, such as input switches of a personal computer especially requiring compactness and lightness, are used in parallel.

First frame 15 that rubs with and bends tapered part 23A of driving spring 23 when the push button switch is pressed is made of an abrasion resistant material such as a metal material formed by die-casting metal such as aluminum or press-working a metal plate. The push button switch is thus provided which is somewhat heavy, but has less degradation due to abrasion of first frame 15 and a long service life.

Embodiment 2

Same elements used in embodiment 1 are denoted with the same reference numbers and are not described in detail.

Figure 7A:
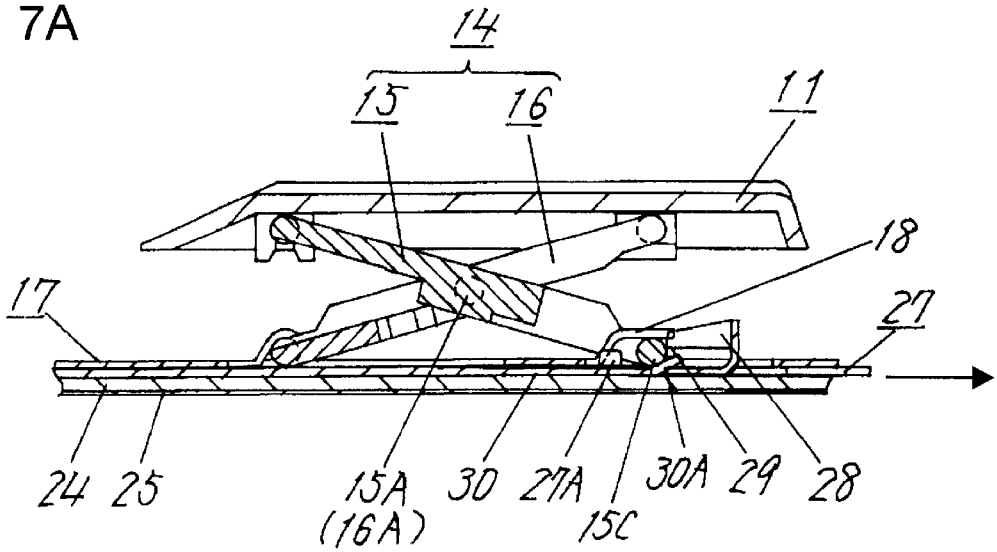
FIG. 7A is a sectional view of a push button switch in accordance with exemplary embodiment 2 of the present invention.
Figure 7B:
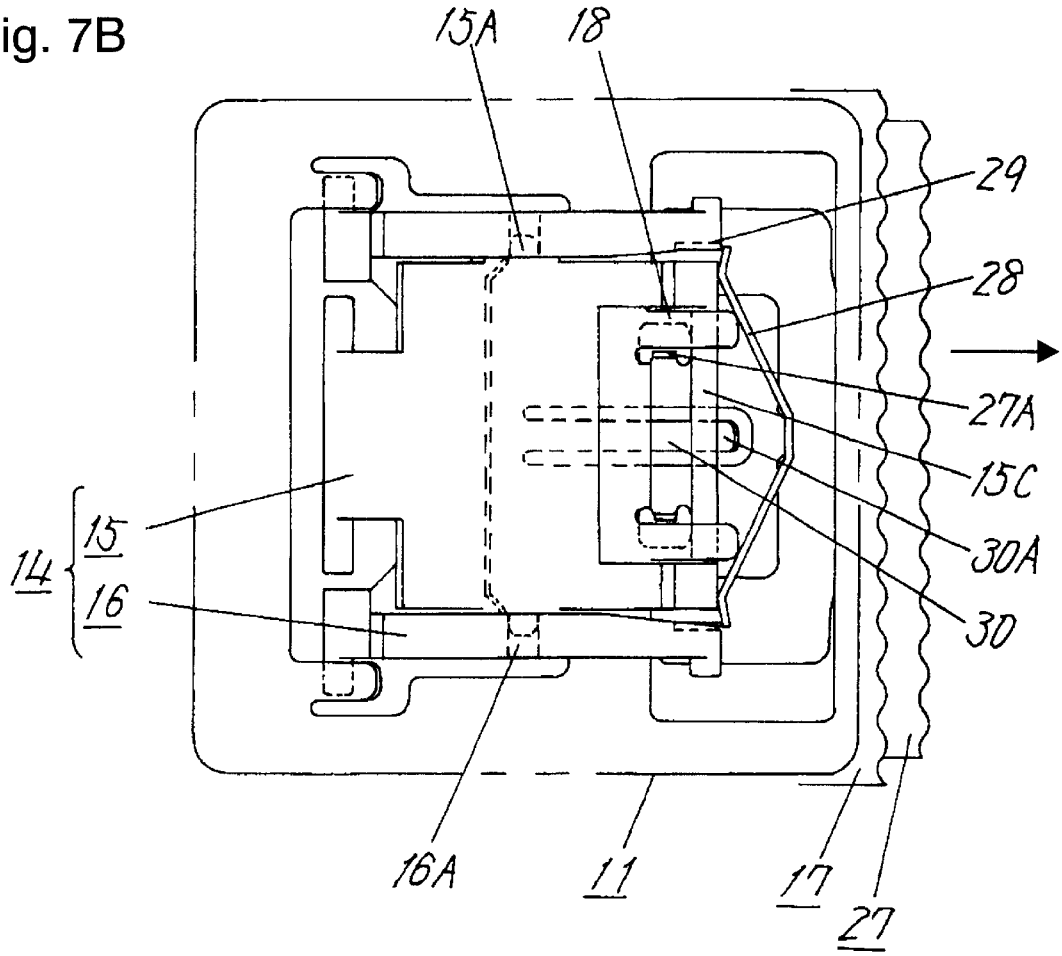
FIG. 7B is a plan view of the switch except for a key top in accordance with embodiment 2.

FIG. 7A is a sectional view of a push button switch in accordance with exemplary embodiment 2 of the present invention, and FIG. 7B is a plan view of the switch except for a key top.

So as to thinly fold an electronic apparatus utilizing the push button switch during its non-use, key top 11 in the push button switch in accordance with this embodiment can be sunk down during the non-use to reduce height and to be stored in the electronic apparatus. A basic structure of this switch comprises spring plate 27 transversely slidably disposed between base 17 and switch member 24, instead of spring plate 20 in the switch in embodiment 1.

Spring plate 27 is made of a thin elastic metal plate, and includes operating spring 28 unitarily formed by punching and bending it, stopper 29 for applying an initial pressure to this, and driving spring 30, similarly to spring plate 20 in the switch in embodiment 1. Projections 27A projecting to the upper part of base 17 are unitarily on the both sides of driving spring 30.

Next, an operation of sinking down the push button switch with such a structure in embodiment 2 will be illustrated with reference to a sectional view of the switch during the sinking down period shown in FIG. 8A and a plan view of the switch except for the key top shown in FIG. 8B.

When spring plate 27 are slid from a state shown in FIG. 7A and FIG. 7B in the direction of arrows shown in FIG. 7A and FIG. 7B, operating spring 28, stopper 29, and driving spring 30 similarly slide in the arrow direction. Operating spring 28 thus slides in a state in which stopper 29 applies an initial pressure to lower latched shaft 15C at the lower end of first frame 5, and an energizing force to link member 14 by tapered part 30A of driving spring 30 disappears. When spring plate 27 further slides in the arrow direction, projections 27A on the both sides of driving spring 30 abuts on lower latched shaft 15C of first frame 15 to shift lower latched shaft 15C in the arrow direction.

Figure 8A:
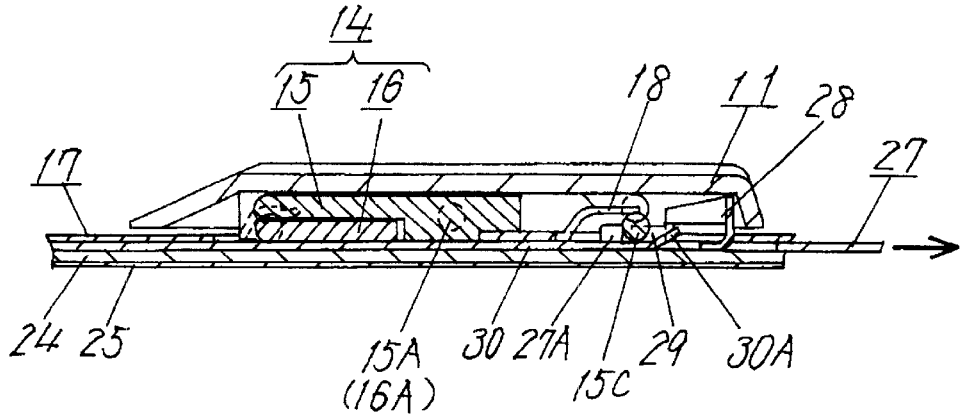
FIG. 8A is a sectional view of the switch in accordance with embodiment 2 during a sinking down period.
Figure 8B:
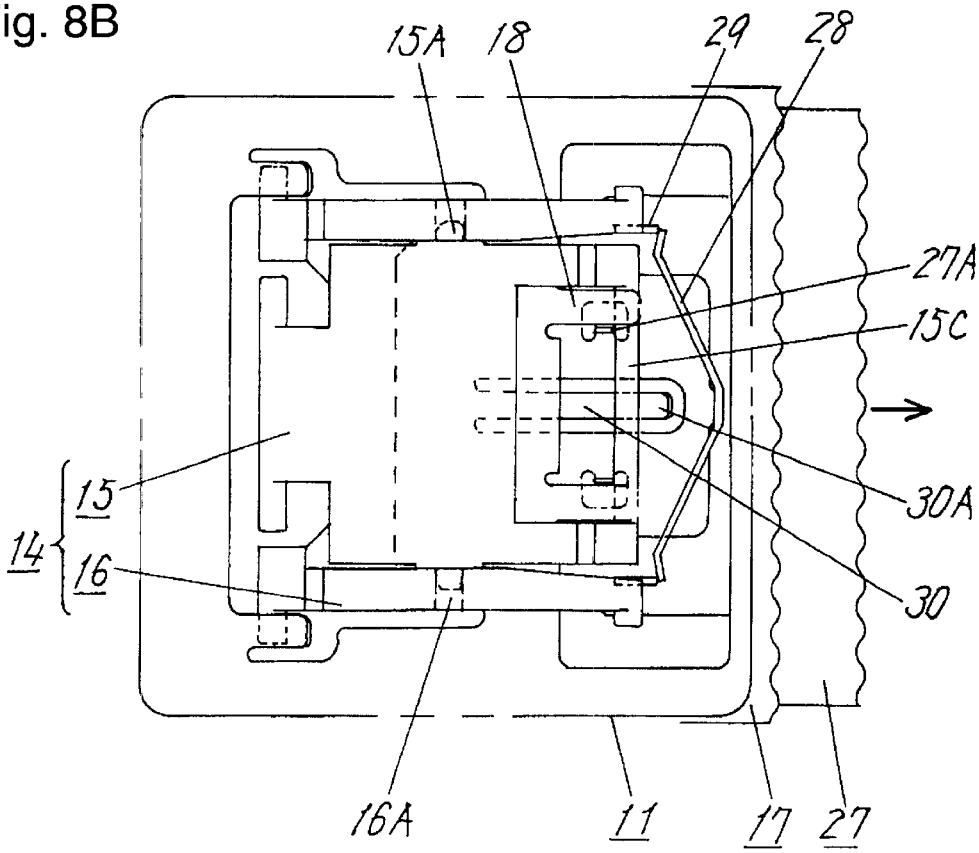
FIG. 8B is a plan view of the switch except for the key top in accordance with embodiment 2.

Link member 14, accompanying this, pivots on an engaging part between circular projection 15A of first frame 15 and circular hole 16A in second frame 16 and is folded similarly to the pressing operation period, and key top 11 sinks down to a position shown in FIG. 8A. In this state, a raising force is not applied to link member 14, link member 14 is stabilized in the folded state since lower latched shaft 15C of first frame 15 abuts on projections 27A of spring plate 27, and key top 11 is kept to be sunk down. Since tapered part 30A of driving spring 30 has slid right, a pressing force is not applied to opposite contacts 24A of switch member 24.

When spring plate 27 slides from this state in the opposite direction of the arrows, projections 27A of spring plate 27 separates from lower latched shaft 15C of first frame 15 of link member 14. Tapered part 30A of driving spring 30 then abuts on lower latched shaft 15C of first frame 15 from its downside to slide lower latched shaft 15C left. Link member 14, accompanying this, rises and presses up key top 11, and the push button switch returns to the original state in FIG. 7A and FIG. 7B. At this time, operating spring 28 smoothly returns to a position shown in FIG. 7A and FIG. 7B in a state in which stopper 29 applies the initial pressure to lower latched shaft 15C, namely a position a predetermined clearance away from lower tip 15D of first frame 15.

A motion during a pressing operation of the push button switch in embodiment 2 is same as in embodiment 1, and thus is not described. In the push button switch in accordance with embodiment 2, spring plate 27 thereof can slide in a predetermined direction simultaneously when the electronic apparatus utilizing this is folded during its non-use. The push button switch can be thus stored lower by a stroke of key top 11.

Embodiment 3

Same elements used in embodiment 1 are denoted with the same reference numbers and are not described in detail.

Figure 9A:
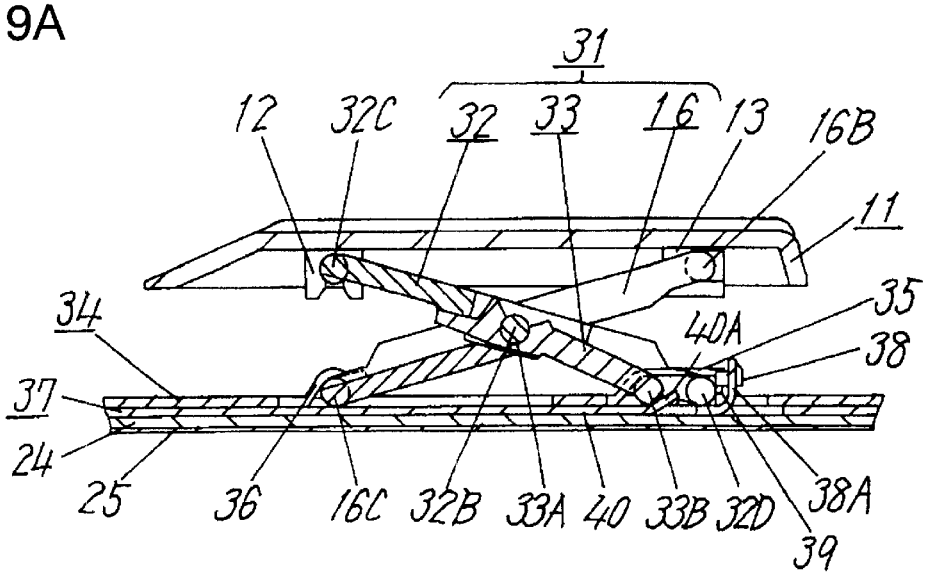
FIG. 9A is a sectional view of a push button switch in accordance with exemplary embodiment 3 of the present invention.
Figure 9B:
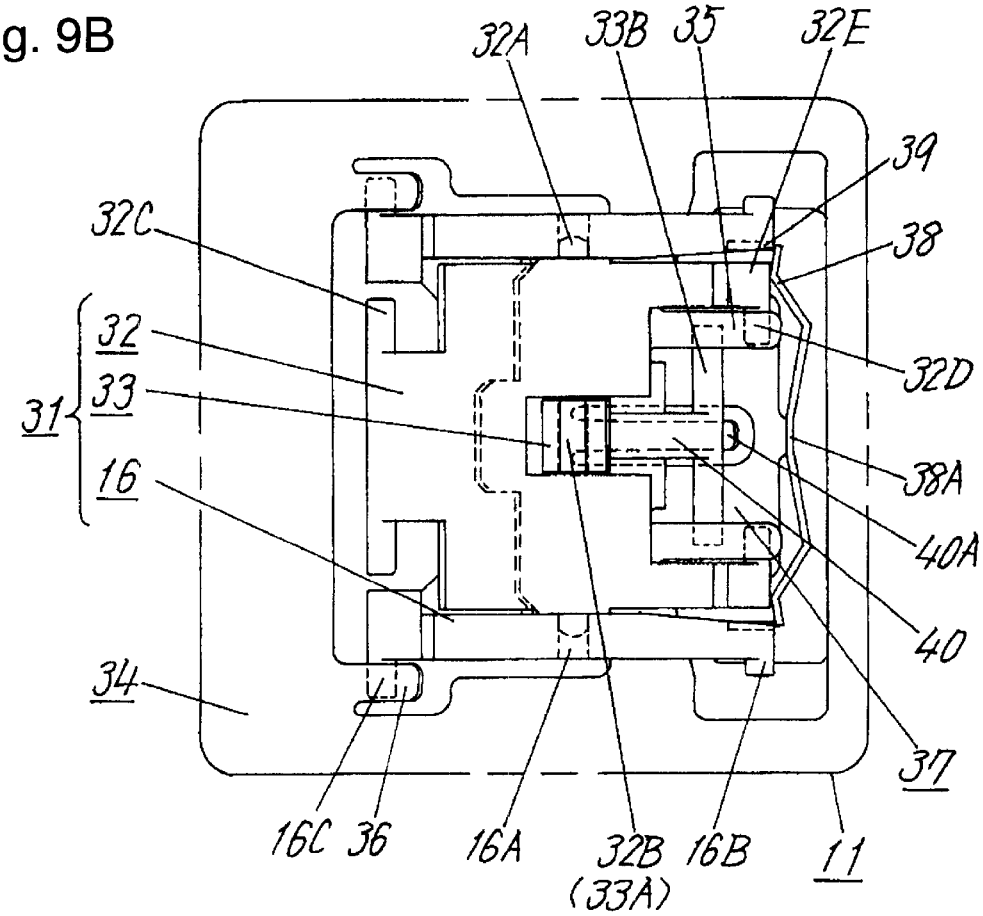
FIG. 9B is a plan view of the switch except for a key top in accordance with embodiment 3.

FIG. 9A is a sectional view of a push button switch in accordance with exemplary embodiment 3 of the present invention, and FIG. 9B is a plan view of the switch except for a key top.

The push button switch in accordance with embodiment 3 has a smaller projecting area and a same basic structure as in embodiment 1. The. switch further comprises resin-made third frame 33 in the central crossing part of resin-made first frame 32 and second frame 16 that form link member 31, as well as elements in embodiment 1.

Figure 10:
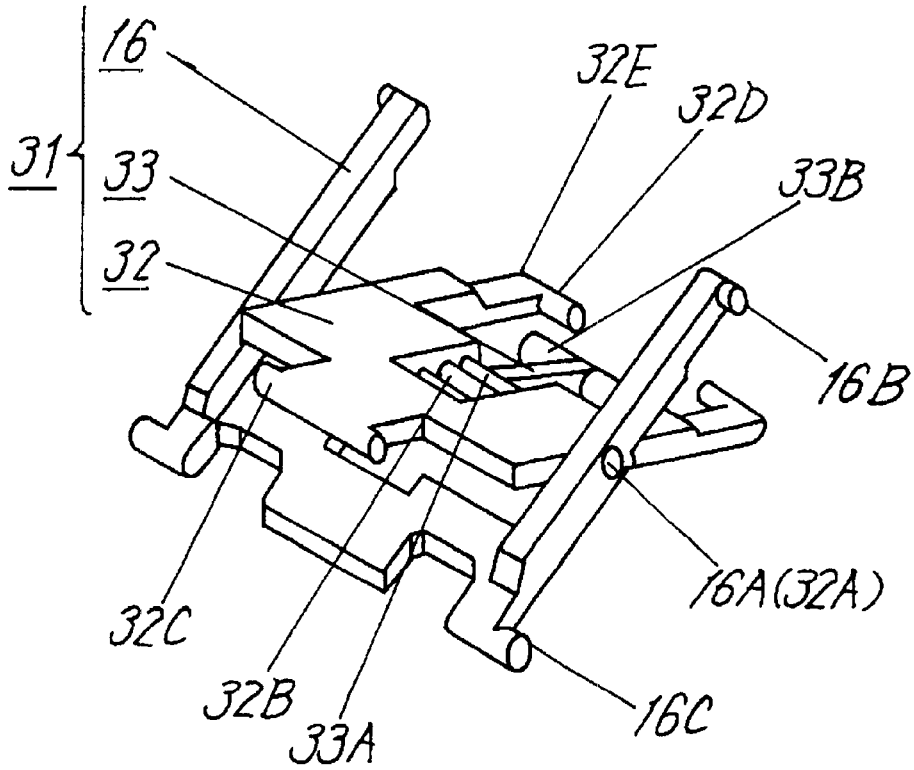
FIG. 10 is an apparent perspective view of a link member of the switch in accordance with embodiment 3.
Figure 11:
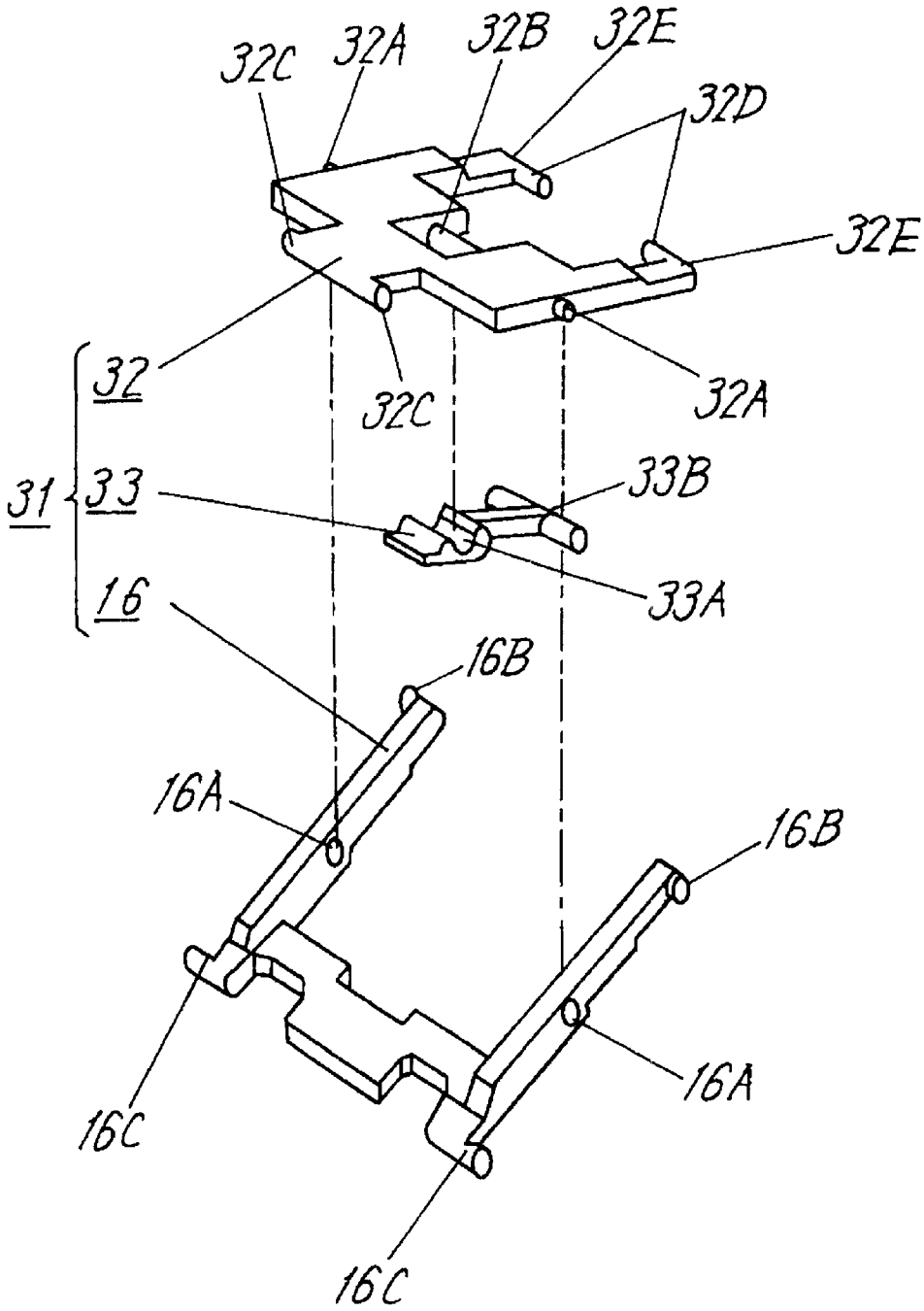
FIG. 11 is an exploded perspective view of the link member of the switch in accordance with embodiment 3.

FIG. 10 is an apparent perspective view of the link member, and FIG. 11 is an exploded perspective view of the link member. As shown in the drawings, link member 31 comprises first frame 32 in a substantially quadrangle plate shape and second frame 16 in a substantially square U shape. Circular projections 32A on both surfaces in an intermediate part of first frame 32 are engaged with circular holes 16A in an intermediate part of arms on both sides of second frame 16, and first frame 32 and second frame 16 are pivotably coupled to each other and assembled in an X shape in side view. This is similar to embodiment 1.

In embodiment 3, first frame 32 further comprises coupling shaft 32B disposed in a U-shaped cutout part formed in its center, concentrically with circular projections 32A. A joint part 33A with a narrow opening in the upper part of third frame 33 is engaged with coupling shaft 32B, so that third frame 33 is rotatably combined with it.

As shown in FIG. 9A and FIG. 9B, upper latched shafts 32C on both sides of the upper end of first frame 32 is pivotably held by first holding part 12 of key top 11. Lower latched shafts 32D on both sides of the lower end of first frame 32 are sandwiched between pair of first support parts 35 unitarily formed in metallic base 34 in a lower part and spring plate 37 below them, and are supported pivotably, slidably, and vertically non-movably. This is similar to embodiment 1.

Driving shaft 33B is formed at the lower end of third frame 33, and the both sides thereof are disposed inside lower latched shafts 32D of first frame 32, so that driving shaft 33B is supported pivotably, slidably, and vertically non-movably between first support parts 35 and spring plate 37.

Upper latched shafts 16B on both sides of the upper end of second frame 16 are pivotably and slidably held by second holding parts 13 of key top 11. Lower latched shafts 16C on both sides of the lower end of second frame 16 are sandwiched between pair of support parts 36 of base 34 and spring plate 37, and are rotatably supported. This is similar to embodiment 1.

Spring plate 37 is made of a thin elastic metal plate, and operating spring 38 formed unitarily with the plate, as a plate spring extended from spring support part 38A, projects over base 34. Spring 38 is held in a state in which stopper 39 formed unitarily with spring plate 37 applies a predetermined initial pressure to it, and faces to lower tips 32E outside lower latched shafts 32D of first frame 32. This is similar to embodiment 1.

Tapered part 40A bent upward at the tip of a driving spring 40 formed unitarily with spring plate 37 presses driving shaft 33B at the lower end of third frame 33, energizes link member 31 in the central direction to raise link member 31, and presses up key top 11.

In this state, lower tips 32E of first frame 32 do not contact with operating spring 38 and has a slight clearance. Switch member 24 is disposed on the lower surface of spring plate 37 so that opposite switch contacts 24A lie directly underneath the root of tapered part 40A of driving spring 40, and substrate 25 is further disposed on the lower surface of switch member 24. Spring support part 38A of operating spring 38 lies outside tapered part 40A at the tip of driving spring 40. This is similar to embodiment 1.

Figure 12A:
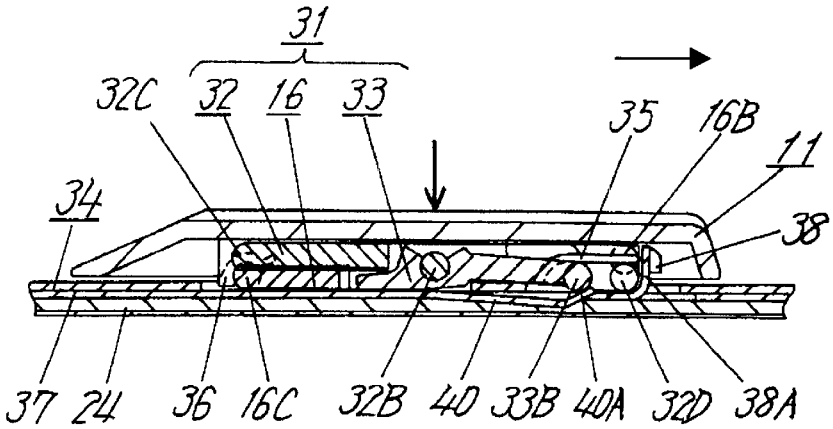
FIG. 12A is a sectional view of the switch in accordance with embodiment 3 during a pressing operation.
Figure 12B:
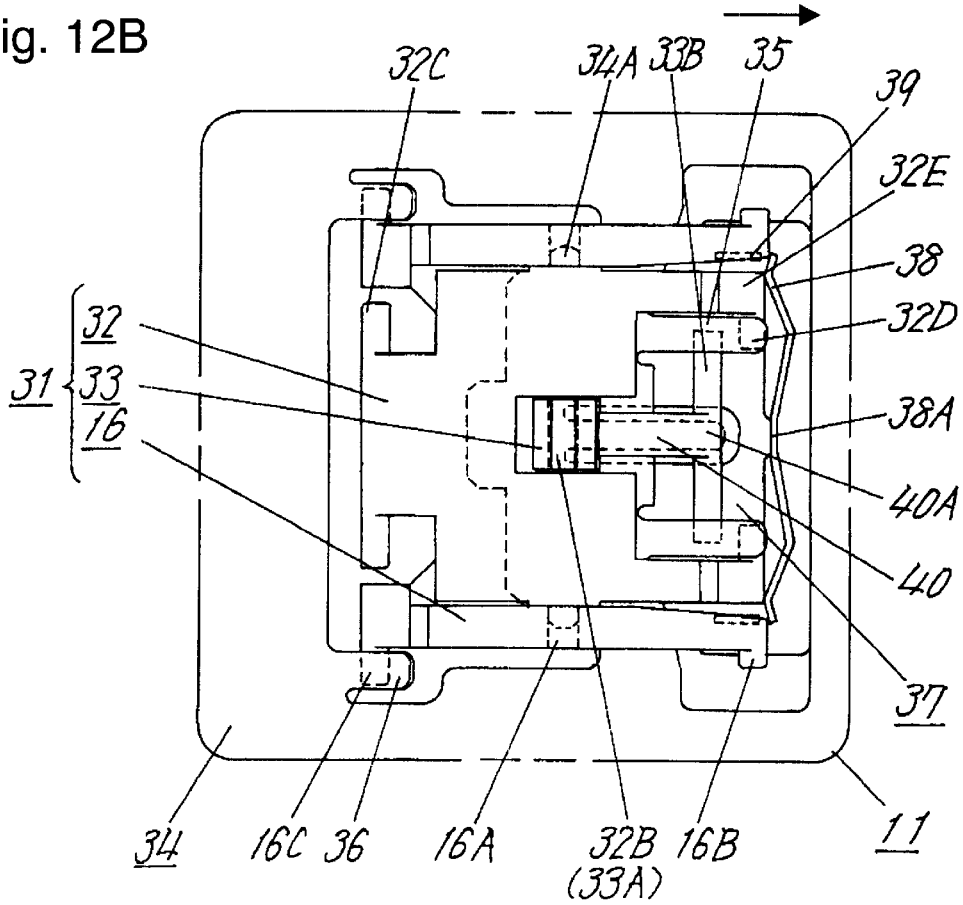
FIG. 12B is a plan view of the switch except for the key top in accordance with embodiment 3.

Next, a motion during a pressing operation of the push button switch with such a structure in accordance with embodiment 3 will be described. FIG. 12A is a sectional view of the switch during the pressing operation, and FIG. 12B is a plan view of the switch except for the key top.

When key top 11 is pressed in the push button switch in accordance with embodiment 3, lower tips 32E of first frame 32 of link member 31 press operating spring 38. Driving shaft 33B of third frame 3 presses tapered part 40A of driving spring 40 to operate switch member 24. Operations other than this operation are same as in embodiment 1, and thus are not described in detail.

In the push button switch in accordance with embodiment 3, third frame 33 supported by base 34 inside lower latched shafts 32D of first frame 32 allows a position at which tapered part 40A of driving spring 40 elastically contacts with and energizes the lower end of link member 31 to be on the central side of the switch than the lower end of first frame 32. Spring support part 38A of operating spring 38 is therefore shifted to the central side of the switch. Accordingly, a projection area of entire operating spring 38 including spring support part 38A, namely a projection area of the push button switch, can be reduced.

Embodiment 4

A push button switch in accordance with embodiment 4 comprises a spring plate sidable between base 34 and switch member 24 similarly to the case in embodiment 2. Spring plate unitarily comprises a projection projecting over base 34.

Figure 13A:
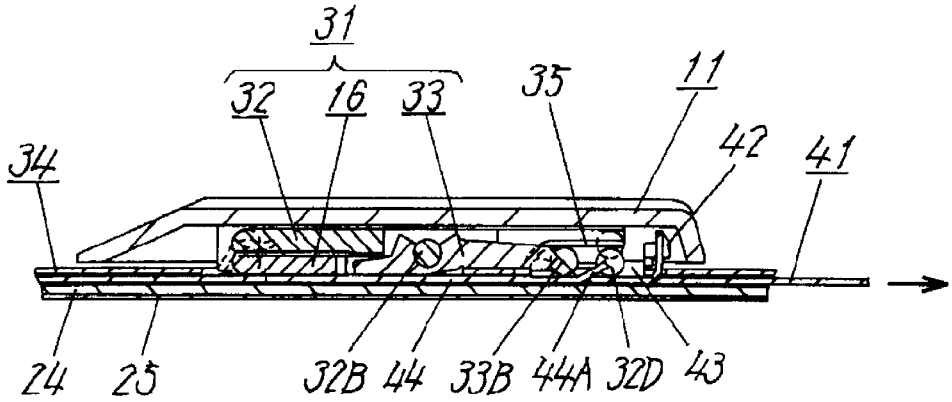
FIG. 13A is a sectional view of a switch in accordance with exemplary embodiment 4 during a sinking down period.
Figure 13B:
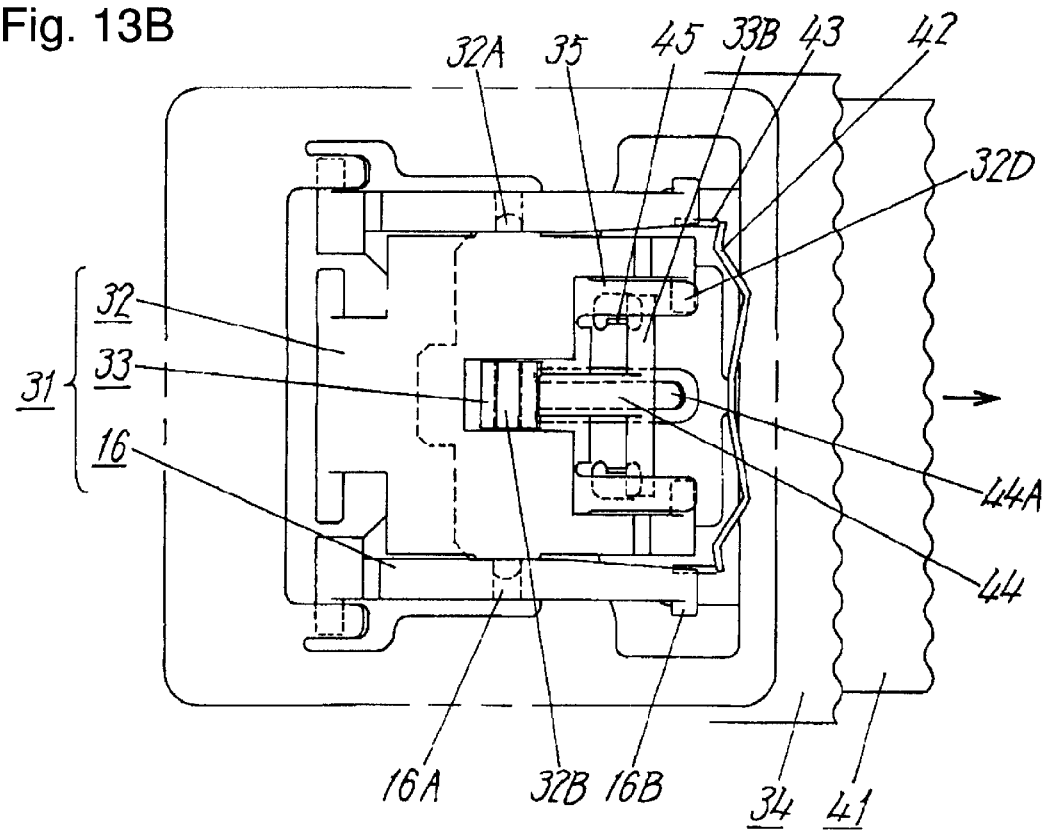
FIG. 13B is a plan view of the switch except for the key top in accordance with embodiment 4.
Figure 14:
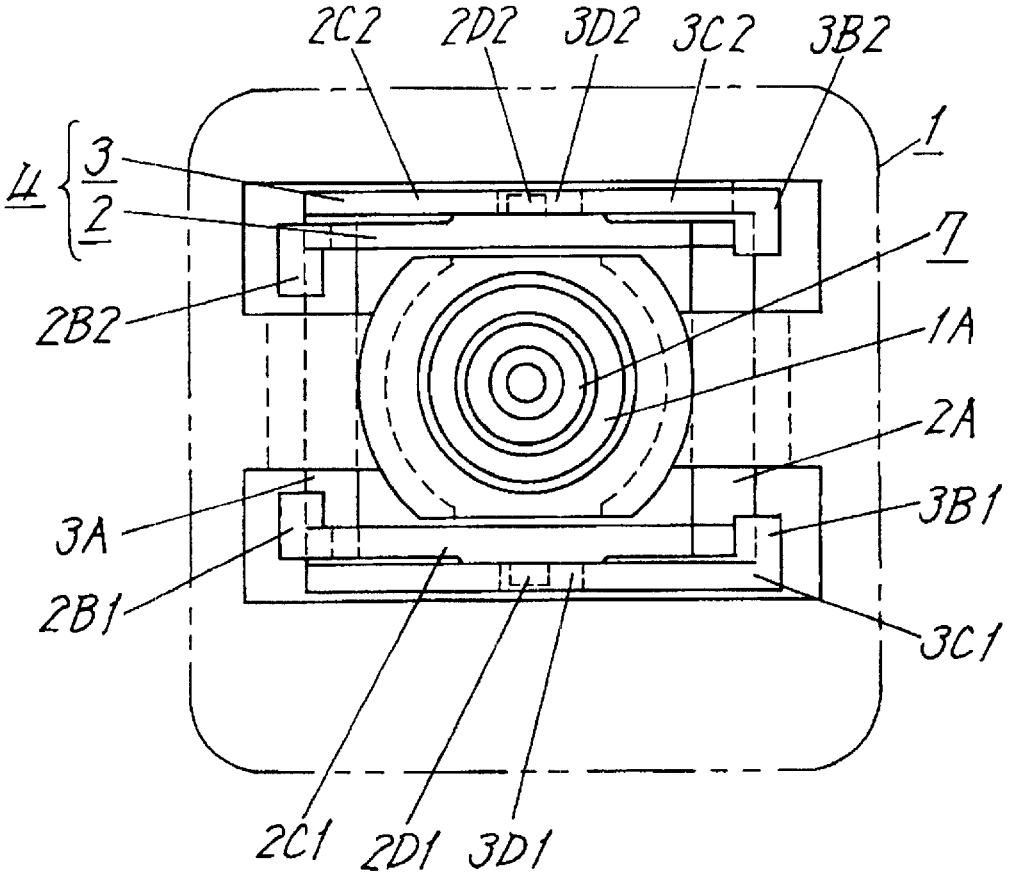
Fig. 14 Prior Art
FIG. 14 is a plan view of a conventional push button switch.
Figure 15:
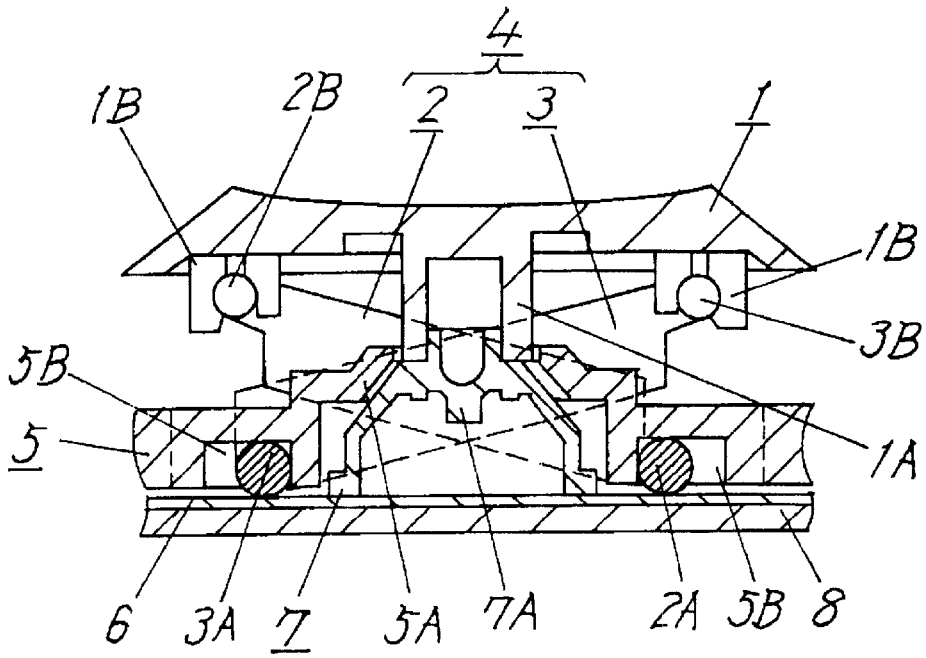
Fig. 15 Prior Art
FIG. 15 is a sectional view of the conventional switch.
Figure 16:
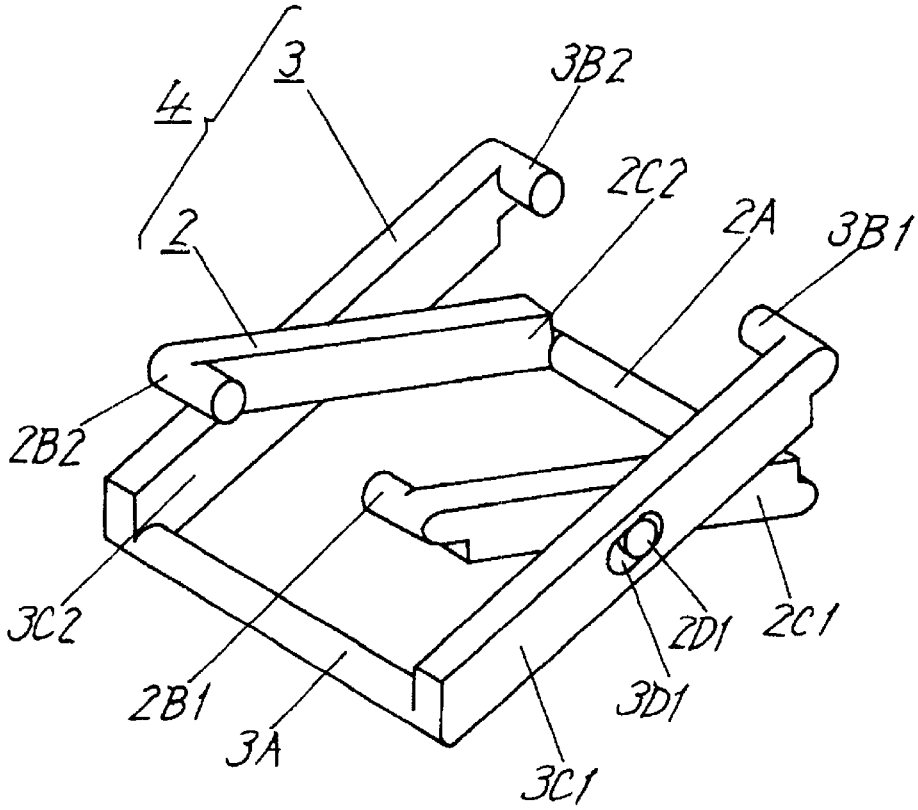
Fig. 16 Prior Art
FIG. 16 is an apparent perspective view of a link member of the conventional switch.
Figure 17:
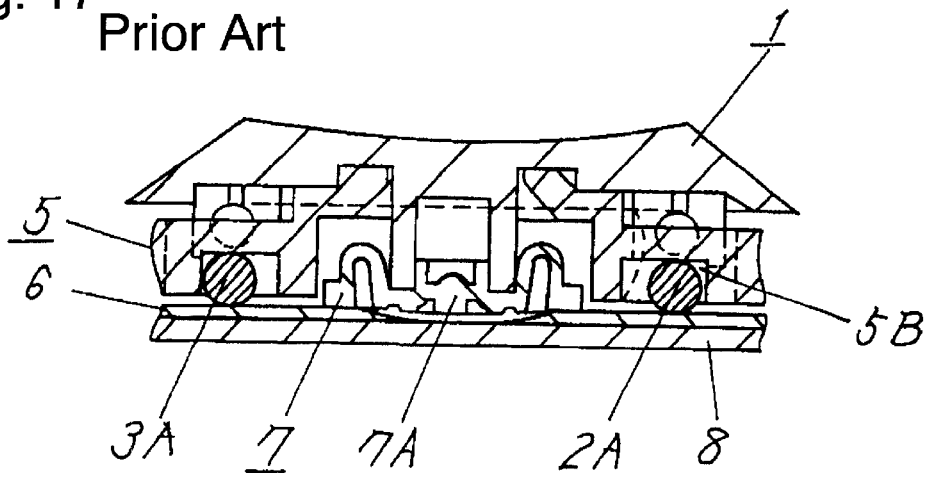
Fig. 17 Prior Art
FIG. 17 is a sectional view of the conventional switch during a pressing operation.

FIG. 13A is a sectional view of the switch during a sinking down period, and FIG. 13B is a plan view of the switch except for the key top. When spring plate 41 is slid in the arrow direction as shown in the drawings, operating spring 42, stopper 43, and driving spring 44 also slide in the arrow direction. Operating spring 42 thus slides in a state in which stopper 43 applies an initial pressure to it, and an energizing force to driving shaft 33B of third frame 33, namely link member 31, by tapered part 44A of driving spring 44 disappears. When spring plate 41 further slides in the arrow direction, projections 45 on the both sides of driving spring 44 abut on driving shaft 33B of third frame 33 to shift it right. Link member 31, accompanying this, pivots on an engaging part between circular projection 32A of first frame 32 and circular hole 16A in second frame 16 and is folded similarly to the pressing operation period. Key top 11 therefore sinks down to a position shown in FIG. 13A, opposite switch contacts 24A of switch member 24 is kept to be stabilized without pressing force.

When spring plate 41 slides from this state in the opposite direction of the arrows, link member 31 rises and presses up key top 11 to return the push button switch to the original state.

In the push button switch in accordance with embodiment 4, spring plate 41 thereof can slide in a predetermined direction simultaneously when the electronic apparatus utilizing the switch is folded during its non-use. The switch can be thus stored lower by a pressing stroke of key top 11.

Additionally, in the push button switch in accordance with embodiment 3 or embodiment 4, third frame 33 rubs with and bends tapered part 40A (44A) of driving spring 40 (44) when the push button switch is pressed, and is made of an abrasion resistant material such as metal material formed by die-casting of aluminum. The push button switch is thus provided which is somewhat heavy, but has less degradation due to abrasion of third frame 33 and a long service life.

What is claimed is:

1. A push button switch comprising:

a key top including first and second holding parts;

first frame having first and second ends, the first end being pivotably held by the first holding part;

a second frame having first and second ends, the first end being held by the second holding part slidably toward and away from the first end of the first frame, the second frame being pivotably coupled to the first frame to form an X-shape;

a base including first and second support parts, the first support part supporting the second end of the first frame slidably toward and away from the second end of the second support part, the second support part pivotably supporting the second end of the second frame;

an operating spring elastically deformed by the second end of the first frame sliding away from the second end of the second frame;

a driving spring elastically contacting with the second end of the first frame from an opposite side of the key top, the driving spring having an angled part pushed by the second end of the first frame sliding away from the second end of the second frame; and a switch member disposed at an opposite side of the key top about the driving spring, the switch member having switch contacts pressed and operated by the driving spring.

2. The push button switch according to claim 1, further comprising a rigid substrate disposed on the switch member at an opposite side of the key top.

3. The push button switch according to claim 1, wherein the base is made of a metal plate, and the first and second support parts are formed unitarily with the base by pressing.

4. The push button switch according to claim 1, further comprising a spring plate made of a thin elastic metal plate disposed between the base and switch member, wherein the operating spring and driving spring are formed unitarily with the spring plate.

5. The push button switch according to claim 4, wherein the spring plate slidably disposed between the base and switch member.

6. The push button switch according to claim 1, further comprising a stopper for keeping the operating spring to be pushed at a predetermined initial pressure with a predetermined clearance between the second end of the first frame and the operating spring while the key top is not pressed.

7. The push button switch according to claim 6, further comprising a spring plate made of a thin elastic metal plate disposed between the base and switch member, wherein the operating spring, driving spring, and stopper are formed unitarily with the spring plate.

8. The push button switch according to claim 7, wherein the spring plate is slidably disposed between the base and switch member.

9. The push button switch according to claim 1, wherein both the first and second frames are made of resin.

10. The push button switch according to claim 1, wherein the first frame is made of abrasion resistant material, and the second frame is made of resin.

11. The push button switch according to claim 1, wherein the first frame is made of metal, and the second frame is made of resin.

12. A push button switch comprising:

a key top including first and second holding parts;

a first frame having first and second ends, the first end is pivotably held by the first holding part;

a second frame having first and second ends, the first end being held by the second holding part slidably toward and away from the first end of the first frame, the second frame being pivotably coupled at a coupling part to form an X-shape;

a third frame having first and second ends, the first end being pivotably held by the first holding part at the coupling part;

a base including first and second support parts, the first support part supporting the second end of the first frame and the second end of the third frame slidably toward and away from the second end of the second support part, the second support part supporting a second end of the second frame pivotably, the base positioning the second end of the third frame between the second end of the first frame and the second end of the second frame;

an operating spring being elastically deformed by the second end of the first frame sliding away from the direction to the second end of the second part;

a driving spring elastically contacting with the second end of the third frame from an opposite side of the key top, the driving spring having an angled part pushed by the second end of the third frame sliding away from the second end of the second frame; and a switch member disposed at an opposite side of the key top about the driving spring, the switch member having switch contacts pressed and operated by the driving spring.

13. The push button switch according to claim 12, further comprising a rigid substrate disposed on the switch member at an opposite side of the key top.

14. The push button switch according to claim 12wherein the base is made of a metal plate, and the first and second support parts are formed unitarily with the base by pressing.

15. The push button switch according to claim 12, further comprising a spring plate made of a thin elastic metal plate disposed between the base and switch member, wherein the operating spring and driving spring are formed unitarily with the spring plate.

16. The push button switch according to claim 15, wherein the spring plate is slidably disposed between the base and switch member.

17. The push button switch according to claim 12, further comprising a stopper for keeping the operating spring to be pushed at a predetermined initial pressure with a predetermined clearance between the second end of the first frame and the operating spring while the key top is not pressed.

18. The push button switch according to claim 17, further comprising a spring plate made of a thin elastic metal plate disposed between the base and switch member, wherein the operating spring, driving spring, and stopper are formed unitarily with the spring plate.

19. The push button switch according to claim 18, wherein the spring plate is slidably disposed between the base and switch member.

20. The push button switch according to claim 12, wherein the first, second, and third frames are made of resin.

21. The push button switch according to claim 12 wherein the third frame is made of abrasion resistant material, and the first and second frames are made of resin.

22. The push button switch according to claim 12, wherein the third frame is made of metal, and the first and second frames are made of resin.

* * * * *

UNITED STATES PATENT AND TRADEMARK OFFICE

CERTIFICATE OF CORRECTION

PATENT NO. : 6,448,520 B1
DATED : September 10, 2002
INVENTOR(S) : T. Inoue

It is certified that error appears in the above-identified patent and that said Letters Patent is hereby corrected as shown below:

Column 9,
Line 43, before the first occurrence of "first" insert -- a --.
Line 54, in both occurrences "support part" should read -- frame --.

Column 10,
Line 51, in both occurrences "support part" should read -- frame --.

Signed and Sealed this

Twenty-ninth Day of April, 2003

JAMES E. ROGAN
*Director of the United States Patent and Trademark Office*